US005086973A

United States Patent [19]

Escallon et al.

[11] Patent Number: 5,086,973

[45] Date of Patent: Feb. 11, 1992

[54] NOZZLE MODULATORS

[75] Inventors: Eduardo C. Escallon; Theodore Parker, both of Elwood; Steven Y. Walters, Anderson, all of Ind.

[73] Assignee: Terronics Development Corp., Elwood, Ind.

[21] Appl. No.: 507,488

[22] Filed: Apr. 11, 1990

[51] Int. Cl.[5] ..... B05B 5/04

[52] U.S. Cl. ..... 239/3; 239/696

[58] Field of Search ..... 239/3, 690, 696, 697, 239/706

[56] References Cited

U.S. PATENT DOCUMENTS

| | | | |
|---|---|---|---|
| 3,579,245 | 5/1971 | Berry | 239/3 X |
| 3,656,171 | 4/1972 | Robertson | 239/690 X |
| 4,152,468 | 5/1979 | Kimmich | 239/3 X |
| 4,324,117 | 4/1982 | Schwob et al. | 239/696 X |
| 4,749,125 | 6/1988 | Escallon et al. | 239/696 X |
| 4,845,512 | 7/1989 | Arway | 239/690 X |

*Primary Examiner*—Andres Kashnikow
*Assistant Examiner*—Kevin P. Weldon
*Attorney, Agent, or Firm*—Lundy & Associates

[57] ABSTRACT

An improved nozzle modulator, an improved nozzle modulator assembly, and an improved coating method comprises a nozzle having a housing. A fluid reservoir communicates with the housing. The nozzle has a nozzle outlet about which a meniscus is formed. A high voltage source is connected to the nozzle. The fluid is dispensed as one or more charged fluid paths from the nozzle upon the actuation of the high voltage source. A plurality of repulsive and attractive electric fields are positioned to surround the fluid path. An electrical biasing means is connected to the electrical fields for biasing the fields and modulating the fluid path to form a homogeneous fog comprising uniformly disbursed droplets moving in a wide variety of directions.

55 Claims, 4 Drawing Sheets

FIG. 2
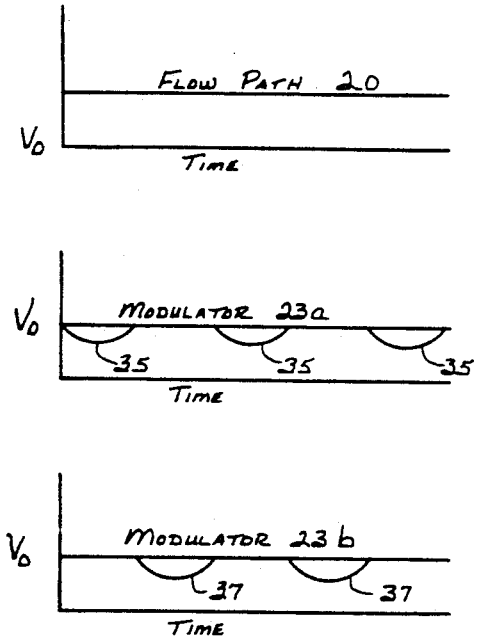
FIG. 3
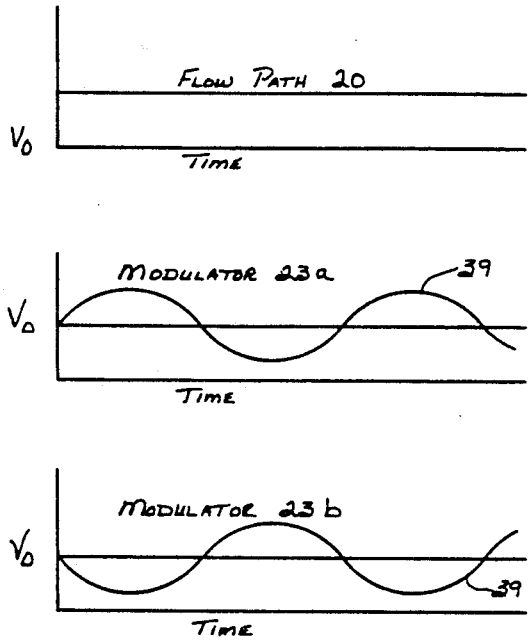
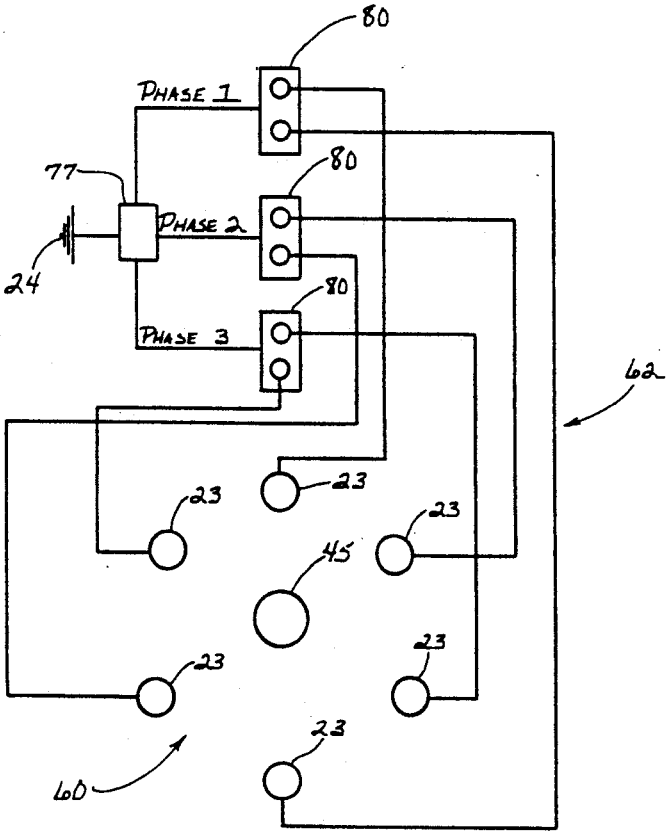
FIG. 8

NOZZLE MODULATORS

BACKGROUND OF THE INVENTION

The present invention pertains to electrostatic fluid dispensing apparatus, and more particularly pertains to electrostatic fluid dispensing nozzle modulators, nozzle modulator assemblies, and methods of electrostatic spraying.

In electrostatic fluid dispensing, a small amount of fluid is electrostatically charged and controllably dispensed in one or more continuous jets or streams or discontinuous paths of droplets. The term "fluid" is used herein to refer to liquids and to other flowable materials and to other materials made flowable by the application of heat or pressure. The term "fluid path" is used herein to refer broadly to ligaments, streams, jets, droplets, sheets and other continuous or discontinuous paths of the fluid.

Previous electrostatic spray nozzles are typically in the form of an electrified capillary, for example Winston, U.S. Pat. No. 3,060,429. In these nozzles, fluid is introduced through a small capillary port, typically about 0.001 inches in diameter, at a pressure which in itself is insufficient to produce flow. By imposing an electric field between the extremity of the nozzle and a conductive, nearby (typically one-quarter inch distant) substrate, small jets of charged liquid can be forced to fire. Electrodes placed adjacent to the jet's path can be impressed with a voltage to steer the jet to provide ink patterns on a paper substrate.

The multi-point nozzle found in Escallon, et al, U.S. Pat. No. 4,749,125, obviates the need for small orifices and limited throughputs. This nozzle has found many useful applications in areas as diverse as high speed metal lubrication and placing chemical treatments on foodstuffs or plants. Such nozzles, with current power sources would be useful with throughput materials having resistivities down to about $10^6$ ohm-centimeters.

Other nozzles, such as the nozzles disclosed in an application for United States Letters Patent filed by Rodenberger and Hunnicutt filed contemporaneously herewith have found many useful applications similar to the Escallon nozzles with materials having resistivities below $10^6$ ohm-centimeters and surface tensions approaching that of deionized water.

However, all of these nozzles have the shortcoming that the dispensed material tends to lie in a planar trajectory for some distance from the nozzle, rather than quickly forming a homogeneous charged fog. As a consequence, objects close to the nozzle and irregular target objects are not coated with the desired uniformity. Unless an array of differently directed nozzles is used rather than a singular nozzle, irregular shapes such as lettuce leaves, waffle irons or the interior of tin cans would not be uniformly coated except along the firing line.

It is therefore highly desirable to provide an improved nozzle modulator, nozzle modulator assembly and coating method.

It is therefore highly desirable to provide a nozzle modulator, a nozzle modulator assembly, and an improved coating method which produce coatings from a single nozzle like that achieved using an array of differently directed nozzles.

It is also highly desirable to provide an improved nozzle modulator, an improved nozzle modulator assembly, and an improved coating method by which objects close to the nozzle and irregular objects can be coated with uniformity.

It is also highly desirable to provide an improved nozzle modulator, an improved nozzle modulator assembly, and an improved coating method in which a homogeneous charged fog may be provided comprising a plurality of similarly charged droplets moving in a variety of different directions.

It is also highly desirable to provide an improved nozzle modulator, an improved nozzle modulator assembly, and an improved coating method in which a homogeneous charged fog may be provided close to the nozzle.

It is finally highly desirable to provide an improved nozzle modulator, an improved nozzle modulator assembly, and an improved coating method which meet all of the above desired features.

SUMMARY OF THE INVENTION

It is an object of the invention to provide an improved nozzle modulator, nozzle modulator assembly and coating method.

It is an object of the invention to provide an improved nozzle modulator, an improved nozzle modulator assembly, and an improved coating method.

It is also an object of the invention to provide an improved nozzle modulator, an improved nozzle modulator assembly, and an improved coating method by which objects close to the nozzle and irregular objects can be coated with uniformity.

It is also an object of the invention to provide an improved nozzle modulator, an improved nozzle modulator assembly, and an improved coating method in which a homogeneous charged fog may be provided close to the nozzle.

It is also an object of the invention to provide an improved nozzle modulator, an improved nozzle modulator assembly, and an improved coating method in which a homogeneous charged fog may be provided comprising a plurality of similarly charged droplets moving in a variety of different directions.

It is finally an object of the invention to provide an improved nozzle modulator, an improved nozzle modulator assembly, and an improved coating method which meet all of the above desired features.

In the broader aspects of the invention, there is provided an improved nozzle modulator, an improved nozzle modulator assembly, and an improved coating method which comprises a nozzle having a housing, a fluid reservoir communicating with the housing, a nozzle outlet in which the fluid forms a meniscus about the outlet whereupon the actuation of a high voltage source, the fluid is dispensed as one or more charged fluid paths, a plurality of opposed and attractive electrical fields surrounding the fluid path, and electrical biasing means connected to the electrical fields for biasing the fields and modulating the fluid paths.

BRIEF DESCRIPTION OF THE DRAWINGS

The above-mentioned and other features and objects of the invention and the manner of attaining them will become more apparent and the invention itself will be better understood by reference to the following description of an embodiment of the invention taken in conjunction with the accompanying drawings wherein:

FIG. 2 is a charge chart showing the charge on the flow path and the modulator conductors over time in a specific embodiment.

FIG. 3 is a charge chart showing the charge on the modulator conductors and the flow path over time in an alternate specific embodiment.

FIG. 8 is a view like FIG. 6, showing a three phase, six conductor modulator of the invention.

DESCRIPTION OF A SPECIFIC EMBODIMENT

Figure 1:
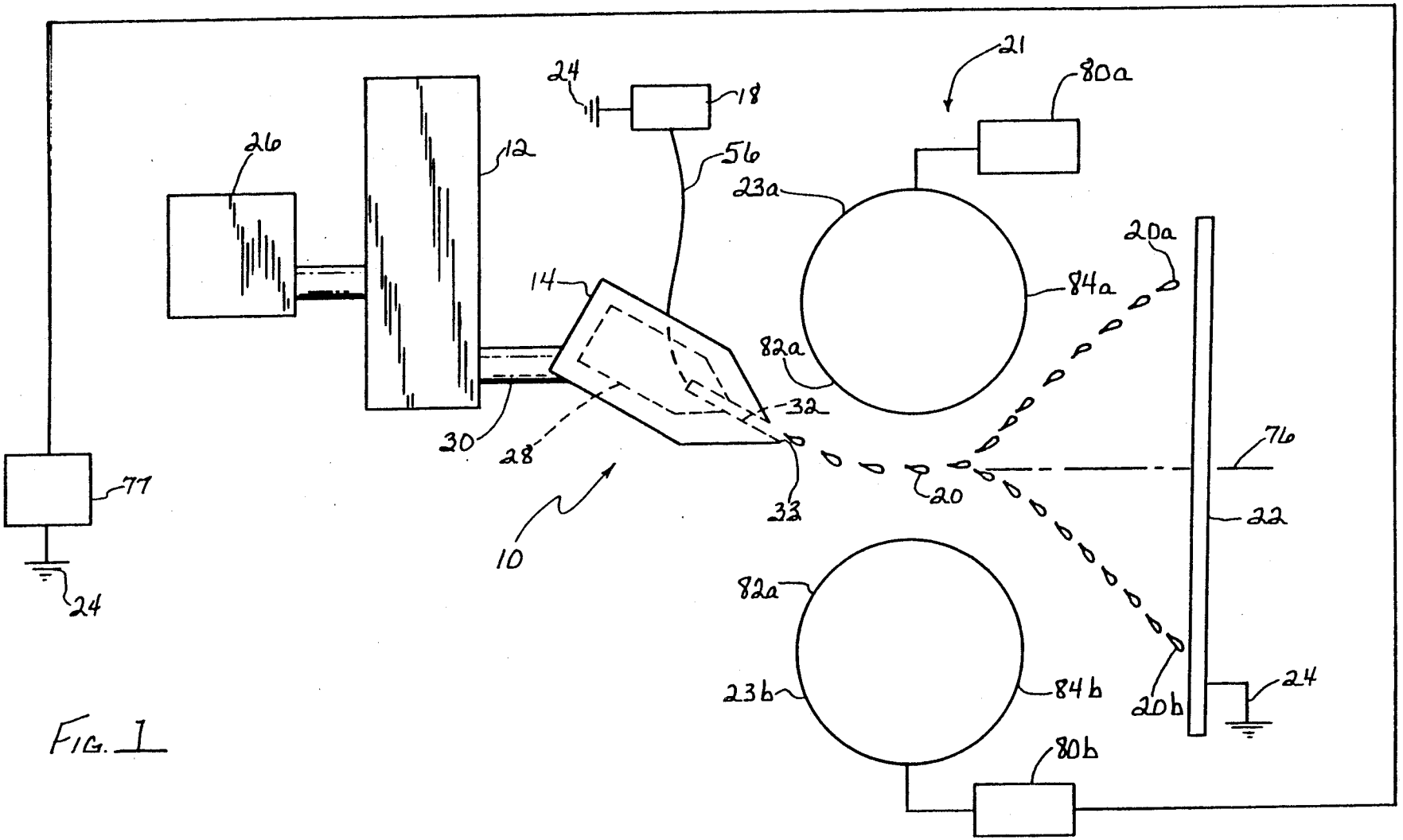
FIG. 1 is a diagrammatic perspective view of the nozzle modulator apparatus of the invention illustrating a nozzle connected to a fluid reservoir, a power supply, a target, the modulator of the invention, and a plurality of fluid flow paths.

Referring to FIGS. 1 and 2, nozzle assembly 10 is illustrated comprising fluid reservoir 12, nozzle 14, high voltage power supply 18, a conductor 56, flow path 20, modulator 21 and target 22. Target 22 is placed in proximity of the trajectory of flow paths 20. Modulator 21 has two conductors 23 placed on opposite sides of flow path 20. Target 22 may be electrically biased and in this embodiment of the invention is shown grounded by ground 24.

Hydrostatic means 26 is provided to fluid reservoir 12 such that a selected pressure is maintained within the fluid reservoir 12 and nozzle 14.

Nozzle 14 defines chamber 28 which is filled with fluid from fluid reservoir 12 which is introduced into chamber 28 via duct 30. Nozzle 14 is made of electrically insulative materials, such as plastic. Nozzle 14 also defines slot 32 at its tip 33. Hydrostatic means 26 maintains the fluid in the reservoir 12 and the nozzle 14 at a precise pressure. The fluid pressure is never sufficient to squirt the fluid through slot 32.

In a specific embodiment, the nozzle 14 may be any of the nozzles disclosed in Escallon, et al, U.S. Pat. No. 4,749,125, issued on June 7, 1988. Incorporation of the entire specification of U.S. Pat. No. 4,749,125 by reference is made herein.

Both of the conductors 23 are located adjacent the trajectory of flow path 20 emerging from the nozzle 14.

Modulator conductors 23 are electrified through a resistor 90, capacitor 92, and transformer 94 network 80, such that conductors 23 alternately assume an attractive charge to the flow path 20. See FIG. 6. A power source 77 is connected between networks 80 to alternate the charge on conductors 23 in accordance with a predetermined routine. In a specific embodiment, depending upon the type of power source 77 either the resistor 90, the capacitor 92 or the transformer 94 may be eliminated from network 80.

In the specific embodiment illustrated in FIG. 1, a positive charge is given to the flow paths 20 and a negative charge is given to each of the modulator conductors 23*a* and *b* upon being activated. Being large diameter conductors relative to the droplets 88 of flow path 20, each conductor 23 distributes a negative field in the diametral region 82 near the nozzle tip 33.

As the positively charged flow path 20 comes into proximity of a negatively charged conductor 23*a*, conductor 23*a* produces an attractive force to flow path 20 as it passes region 82, but due to inertia force, the flow path does not impact the conductor 23*a*. Instead, the flow path 20 emerges at spaced intervals in the form of charged droplets 88 at a location spaced from conductor 23 but at a position 20*a* deviating from the axis 76 of flow path 20.

Similarly, when the other modulator conductor 23*b* is activated, a negative charge is given to other conductor 23*b*. Being a large diameter conductor relative to the positively charged droplets of flow path 20, conductor 23*b* presents a large attractive force in the diametral region 82*b* near the nozzle tip 33 and a lessened force towards backside 84*b*. As the charged flow path 20 comes into proximity of conductor 23*b*, conductor 23*b* produces an attractive force on the flow path as it passes region 84*b* but due to inertia force, the flow path does not impact modulator 84*b*. Instead, the flow path emerges at a spaced interval in the form of charged droplets adjacent conductor 23*b*, but again, at a position 20*b* deviating from the axis 76 of flow path 20.

In specific embodiments, droplet formation is highly uniform and the droplets may be disbursed over an area ranging from deviant positions 20*a* and 20*b* and there between by the oscillation of the flow path 20 by the activation of modulator 21. In slow motion, the flow path is moved between positions 20*a* and 20*b* by modulator conductors 23*a* and 23*b* to simulate a "paintbrushing" action. As a result of the "paintbrushing" action, the target 22 is presented with a fog of highly uniform, charged droplets disbursed over the entire area of the target with each of the droplets moving in a different direction. This type of fog enhances the coating of targets of irregular shapes as will be mentioned hereinafter.

In other specific embodiments, modulator conductors 23*a* and 23*b* are charged by voltages of alternating, opposite and like polarities to the droplets of flow path 20 as shown in FIGS. 2 and 3.

In FIG. 2, flow path 20 is shown to have a constant positive charge and modulator conductors 23*a* and 23*b* are shown to have alternating negative charges imposed by voltages of alternating current. In this embodiment, conductor 23*a* is charged negatively shown by sine wave 35, then modulator 23*b* is charged negatively as shown by sine wave 37 and then conductor 23*a* is again charged negatively as shown by sine wave 39. This is repeated to form the "paintbrushing" action of flow path 20.

In still other specific embodiments, both conductors are charged at all times and the polarities are merely changed by any of the techniques described herein. In these embodiments, when conductor 23*a* is attracting droplets 88, conductor 23*b* is repelling droplets 88, and visa versa. One embodiment of this concept is shown in FIG. 3. As shown in FIG. 3, conductors 23*a* and 23*b* are charged by alternating voltages. Flow path 20 is again charged positively at the same level.

In other embodiments, the flow path 20 can be charged negatively in the embodiment of FIG. 3 and in still other specific embodiments, other charge patterns may be used so long as the modulator conductors 23 are alternately charged to present a charge differential between the droplets and the modulator conductors 23 so as to produce the desired "paintbrushing" action.

Figure 4:
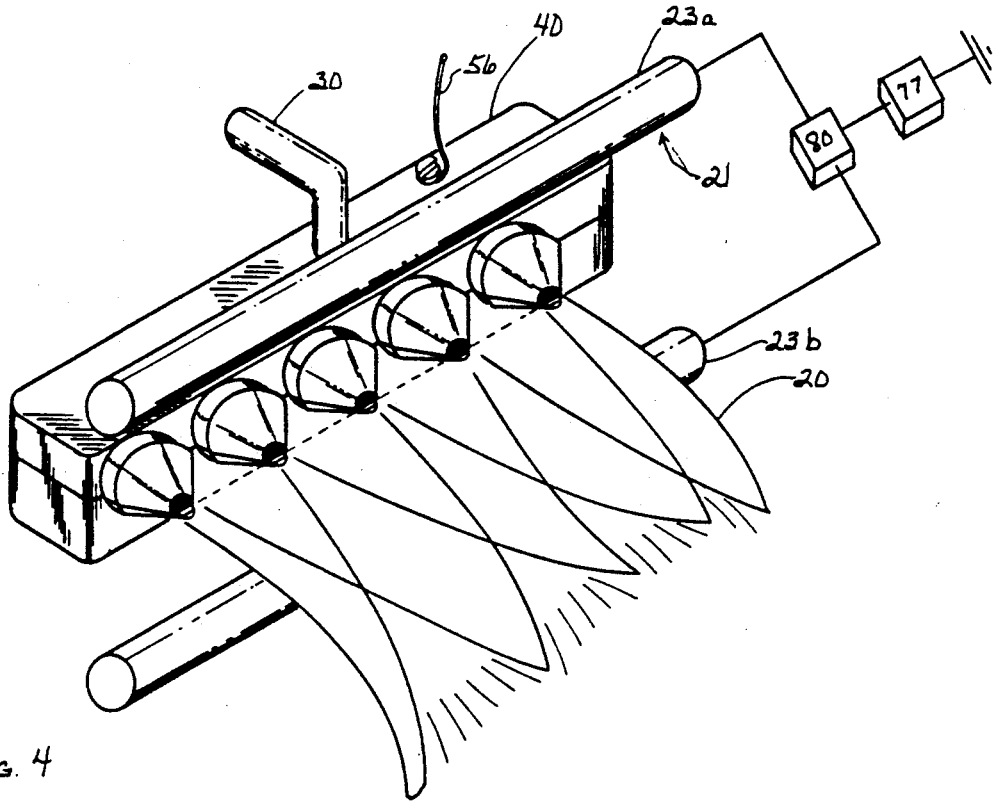
FIG. 4 is a perspective view of an alternate embodiment of the nozzle and modulator of the nozzle apparatus of the invention illustrated in FIG. 1.

In another alternate embodiment, nozzle 14 may take the form of nozzle 40, as disclosed in FIG. 4, to present to target 22 a plurality of fluid flow paths 20. Nozzle 40 is mounted adjacent modulator conductors 23*a* and 23*b* such that flow paths 20 pass between modulator conductors 23*a* and 23*b*. In this embodiment, nozzle 40 may be any of the multiple nozzles disclosed in U.S. Patent Application entitled *Nozzle For Low Resistivity Flowable Fluids,* filed by Rodenberger and Hunnicutt, contemporaneously herewith. Incorporation by reference of the entire specification of that application is made herein.

Figure 5:
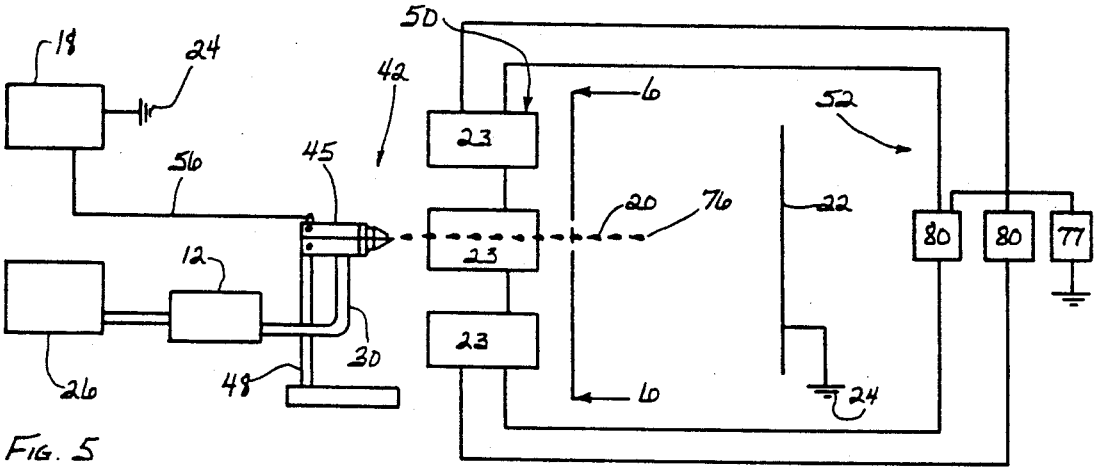
FIG. 5 is a diagrammatic perspective view of a second nozzle modulator apparatus of the invention illustrating a nozzle, a reservoir, a power supply, a target, a two phase modulator having a plurality of conductors, and a plurality of fluid flow paths.

Referring now to FIG. 5, an alternate dispensing apparatus 42 of the invention is shown including a nozzle 45, a nozzle support 48, fluid reservoir 12, a fluid duct 30, high voltage power supply 18, a conductor 56 and a hydrostatic control 26. Fluid path 20 is directed from nozzle 45 to the proximity of target 22, which may be electrically biased and may, for example, be grounded by ground line 24. Fluid is provided by reservoir 12 through fluid duct 30 to nozzle 45 at a selected hydrostatic pressure ranging from atmospheric pressure to elevated pressure. The fluid pressure is controlled by hydrostatic control 26 and is in all cases below that necessary to force or squirt fluid from nozzle 45 without the imposition of an electrical charge on the fluid.

The nozzle 45 in dispensing apparatus 32, may be any of the nozzles disclosed in U.S. Patent Application entitled *Nozzle For Low Resistivity Flowable Fluids,* filed by Rodenberger and Hunnicutt contemporaneously herewith.

Figure 6:
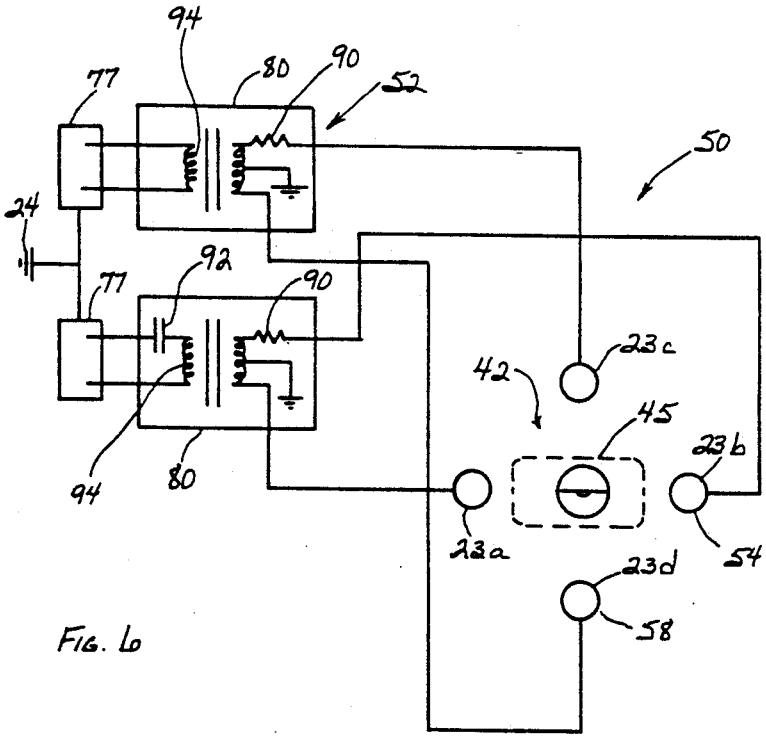
FIG. 6 is an end view of the nozzle apparatus of FIG. 5 taken substantially along line 6—6 of FIG. 5.

Referring now to FIGS. 5 and 6, a modulator 50 is shown positioned between the nozzle 45 and the target 22. Modulator 50 is shown to include four massive modulator conductors 23 located slightly forward from and at a radial offset from axis 76 and electrical circuitry 52 for imposing an alternating charge on modulator conductors 23. In the specific embodiment shown, circuitry 52 includes networks 80 and a power source 77.

In a particular embodiment of the dispensing apparatus 42 of the invention, a charge is applied to two pairs 54, 58 of opposed conductors 23, alternatively. In other particular embodiments, a charge is applied to the opposed modulator conductors 23 of one pair 54 of modulator conductors 23, alternately; and then to the opposed modulator conductors 23 of the other pair 58, alternately.

In specific embodiments, each pair 54, 58 of modulator conductors 23 are charged relative to flow path 20 as described hereinabove. Both of the modulators, shown in FIGS. 5 and 6 and FIGS. 1 and 4 are charged with 2 phase, alternating current as above described. Thus, the nozzle modulator assembly, shown in FIGS. 1 and 4 and in FIGS. 5 and 6, both present to the target a fog having uniformly charged droplets moving in different directions as aforedescribed produced by the "paintbrushing" action of the flow paths induced by the modulators 21 and 50.

In the embodiment illustrated in FIGS. 5 and 6, other alternatives are possible in view of the four conductors 23 of modulator 50 shown in FIGS. 5 and 6 rather than the two conductors 23 of the modulator 21 shown in FIGS. 1 and 4. In the embodiments shown in FIGS. 5 and 6, the flow path 20 may be oscillated back and forth between first pair 54 of modulator conductors 23*a* and 23*b* subsequently oscillated back and forth between second pair 58 of modulator conductors 23*c* and 23*d*. Thus, a "paintbrush" action can be induced into the flow path 20 first in one pair of opposite directions and thereafter in a second pair of opposite directions. Both of the opposite directions in the embodiment shown in FIGS. 5 and 6 would be generally perpendicular to each other.

Further and alternatively, the modulator conductors 23 of the dispensing nozzle modulator assembly shown in FIGS. 5 and 6, can be charged alternately on either a clockwise or counterclockwise rotating basis, in which the fluid flow path generally forms a spiral having a diametral dimension essentially the same as the distance between fluid flow paths 20*a* and 20*b* as above described with regard to the embodiment of FIGS. 1 and 4. In this embodiment, conductor 23*a* is first charged, 23*c* is second charged, conductor 23*b* is third charged, and conductor 23*d* is fourth charged for a clockwise rotation. For a counterclockwise rotation, the conductors 23*a*, 23*d*, 23*b*, and 23*c* are charged in a counterclockwise rotation. In all of these embodiments, the target 22 is presented with a fog having a plurality of uniform particles similarly charged, all moving in different directions.

In the embodiments in which the charges on the modulator conductors 23*a*, *b*, *c*, and *d* are charged in the clockwise or counterclockwise rotation, the shape of the fog formed in cross-section would be noncircular and more accurately described as oval shaped.

Figure 7:
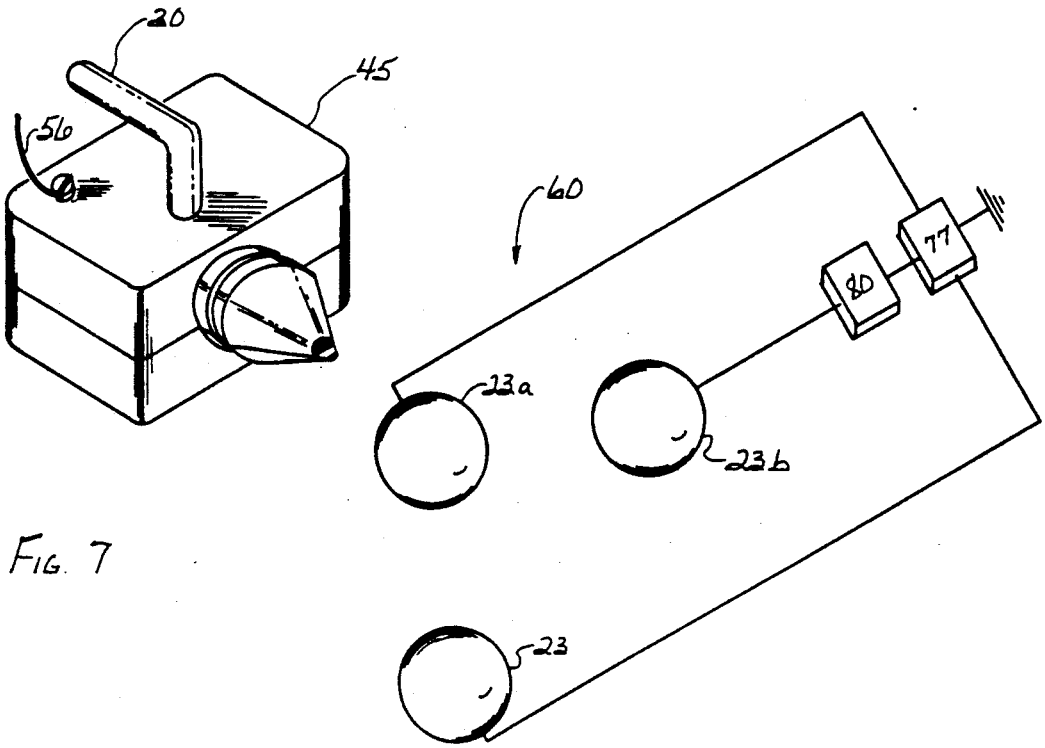
FIG. 7 is a perspective view of the nozzle shown in FIG. 5 and a three phase modulator with three conductors rather than the two phase modulator shown in FIGS. 5 and 6.

In still other embodiments of the fluid dispensing nozzle modulator assembly of the invention, a three phase modulator 60 as shown in FIGS. 7 and 8 may be useful. In these three phase modulators 60, the fog presented to the target in cross-section is more circular than the fog presented to the target in the aforedescribed two phase systems. These modulators 60 have a circular array of three or multiples of three modulator conductors 23 (three are shown in FIG. 7 and six are shown in FIG. 8) connected to circuit 62 by which modulator conductors 23 are each (for example, FIGS. 2 and 3 for each pair) energized sequentially out of phase with each other.

The embodiments of FIGS. 7 and 8 can be utilized to produce a flow path which in slow motion would form a spiral, as above described, and the resulting fog of charged particles. The respective conductors 23 of the modulator can be charged in a rotating basis in both clockwise and counterclockwise directions. Similarly, the fluid dispensing nozzle modulator 60 shown in FIG. 8 can be utilized to present the afore described "paintbrushing" action in three directions, each deviating from each other 120° or the aforesaid spiral pattern, which in cross-section, would be more near circular than that produced by the embodiments of either FIGS. 5 and 6, as desired.

In operation, the dispensing apparatus illustrated in FIGS. 1 and 4, alternating the voltages between modulator conductors 23 cause fluid flow path 20 to oscillate back and forth from adjacent modulator conductor 23*a* to adjacent modulator conductor 23*b* in a "paintbrush" action. Similarly, the dispensing apparatus shown in FIGS. 5, 6, 7 and 8 may similarly provide for the fluid flow path 20 from nozzle 45 to oscillate between a first pair of opposite modulator conductors 23 and then between a second pair of modulator conductors 23, etc. In the nozzle apparatus shown in FIG. 6, these oscillating flow paths would be generally perpendicular to each other.

Alternatively, by charging modulator conductors 23 in a clockwise or counterclockwise sequence, the flow path from nozzle 45 can be rotated to otherwise form a spiral flow path emanating from nozzle 45 in either a clockwise or counterclockwise direction. Such rotating or oscillating flow paths, when dropletized, produces a fog or mist of dispensed liquid as aforedescribed. Other flow paths may be devised depending upon the field imposed by the modulators 21, 50 and 60.

The dispensing apparatus of the invention may be utilized to coat various irregular shapes with the fluid dispensed from the nozzle uniformly irrespective of the irregularity. Shallow cans, such as tuna cans, can be coated uniformly between the sides and over the bottom by this technique, the surface of a waffle iron can be coated uniformly with vegetable oil by this technique. Furthermore, irregular foliage, such as lettuce leaves, can be uniformly coated with insecticide by this technique.

The fog or mist produced by the nozzle modulators of the invention is unique in that the droplets forming the fog are highly uniform, similarly charged, and are each moving in a variety of random directions resulting from the nozzle output velocity, the change in direction imposed on the fluid paths by the constantly changing field of the modulators of the invention. This unique fog or mist enhances the coating of irregular shapes as above described. In most specific embodiments, both the aerodynamic and electrostatic forces on the droplets of the mist or fog may overcome the gravitational forces on the droplets forming the fog or mist.

While a specific embodiment of the invention has been shown described herein for purposes of illustration, the protection afforded by any patent which may issue upon this application is not strictly limited to the disclosed embodiment; but rather extends to all structures and arrangements which fall fairly within the scope of the claims which are appended hereto:

What is claimed is:

1. A nozzle modulator comprising at least one conductor arranged in spaced relation to a charged flow path of droplets from an electrostatic nozzle, a voltage source connected to said conductor, said conductor alternately being charged forming a homogeneous fog from said flow path comprising uniformly disbursed droplets of generally uniform size and charge moving in a wide variety of directions.

2. The modulator of claim 1 wherein said voltage source is transformed direct current voltage of opposite polarity to said flow path.

3. The modulator of claim 1 wherein said conductor is alternatively being charged similarly to said flow path and being uncharged.

4. The nozzle modulator of claim 1 wherein said conductor is being alternatively charged oppositely of said flow path and being uncharged.

5. The nozzle modulator of claim 1 wherein said conductor is alternately being charged similarly of said flow path and oppositely of said flow path.

6. The modulator of claim 1 wherein said voltage source is rectified alternating current.

7. The modulator of claim 1 wherein a plurality of conductors are spaced from each other and positioned around said charged flow path, each of said conductors being connected to a transformer network, and each network being connected to said power source.

8. The modulator of claim 7 wherein there are two conductors, said conductors being on opposite sides of said flow paths, said conductors being alternately charged oppositely of said flow path and uncharged whereby said flow path is alternatively moved toward and away from said conductors, respectively.

9. The modulator of claim 7 wherein there are two conductors, said conductors being on opposite sides of said flow paths, said conductors being alternatively charged similarly of said flow path and uncharged whereby said flow path is alternatively moved toward and away from said conductors, respectively.

10. The modulator of claim 7 wherein there are a plurality of nozzles arranged in a row, each of said nozzles having a flow path, said flow paths being in side by side orientation and define a plane, said conductors being elongated and positioned on opposite sides of said plane, said conductors being on opposite sides of said flow paths, said conductors being alternately charged oppositely of said flow path and uncharged whereby said flow path is alternatively moved toward and away from said conductors, respectively.

11. The modulator of claim 7 wherein there are a plurality of nozzles arranged in a row, each of said nozzles having a flow path, said flow paths being in side by side orientation and define a plane, said conductors being elongated and positioned on opposite sides of said plane, said conductors being on opposite sides of said flow paths, said conductors being alternately charged similarly of said flow path and uncharged whereby said flow path is alternatively moved toward and away from said conductors, respectively.

12. The modulator of claim 7 wherein there are three spaced apart conductors, said conductors being positioned to surround said flow path, said conductors being alternately charged oppositely of said flow path and uncharged in rotation about said flow path, whereby said flow path is alternatively moved toward and away from said conductors, respectively.

13. The modulator of claim 7 wherein there are three spaced apart conductors, said conductors being positioned to surround said flow path, said conductors being alternately charged similarly of said flow path and uncharged in rotation about said flow path, whereby said flow path is alternatively moved toward and away from said conductors, respectively.

14. The modulator of claim 7 wherein there are a plurality of pairs of conductors, said conductors of each pair being positioned on opposite sides of said flow path, said conductors being alternately charged oppositely of said flow path and uncharged whereby said flow path is alternatively moved toward and away from said conductors, respectively.

15. The modulator of claim 7 wherein there are a plurality of pairs of conductors, said conductors of each pair being positioned on opposite sides of said flow path, said conductors being alternately charged similarly of said flow path and uncharged whereby said flow path is alternatively moved toward and away from said conductors, respectively.

16. The nozzle modulator of claim 7 wherein there are two conductors, said conductors being on opposite sides of said flow path, said conductors being alternately charged similarly of said flow path and oppositely of said flow path whereby said flow path is alternately moved toward and away from said conductors, respectively.

17. The modulator of claim 7 wherein there is a plurality of nozzles arranged in a row, each of said nozzles having a flow path, said flow paths being in side by side orientation and define a plane, said conductors being elongated positioned on opposite sides of said plane, said conductors being on opposite sides of said flow paths, said conductors being alternately charged oppositely of said flow path and similarly of said flow path whereby said flow path is alternately moved toward and away from said conductors, respectively.

18. The modulator of claim 7 wherein there are two conductors, said conductors being on opposite sides of said flow path, one of said conductors being alternately charged oppositely of said flow path and uncharged, the other of said conductors being alternately charged similarly of said flow path and uncharged, the charging of said conductors being phased to assist moving said flow path alternately toward and away from said conductors, respectively.

19. The modulator of claim 7 wherein there is a plurality of nozzles arranged in a row, each of said nozzles having a flow path, said flow path being in side by side orientation and define a plane, said conductors being elongated positioned on opposite sides of said plane, said conductors being on opposite sides of said flow paths, said conductors being alternately charged oppositely of said flow path and uncharged, the other of said conductors being alternately charged similarly of said flow path and uncharged, said conductors being charged so as to move said flow path alternately toward and away from said conductors, respectively.

20. The modulator of claim 7 wherein there are three spaced apart conductors, said conductors being positioned to surround said flow path, said conductors being alternately charged oppositely of said flow path and uncharged in rotation about said flow path whereby said flow path is alternately moved toward and away from said conductors, respectively.

21. The modulator of claim 7 wherein there are three spaced apart conductors, said conductors being positioned to surround said flow path, said conductors being alternately charged oppositely of said flow path and uncharged while the other of said conductors are being alternately charged similarly of said flow path and uncharged in rotation about said flow path whereby said flow path is alternately moved toward and away from said conductors, respectively.

22. The modulator of claim 7 wherein there is a plurality of pairs of conductors, said conductors of each pair being positioned on opposite sides of said flow path, said conductors being alternately charged oppositely of said flow path and uncharged, said conductors being charged so as to move said flow path alternately toward and away from said conductors, respectively.

23. The modulator of claim 7 wherein there is a plurality of pairs of conductors, said conductors of each pair being positioned on opposite sides of said flow path, said conductors being alternately charged oppositely of said flow path and uncharged, the other of said conductor of the same pair being alternately charged similarly of said flow path and uncharged, said conductors being charged so as to move said flow path alternately toward and away from said conductors, respectively.

24. The modulator of claim 13 wherein said conductors are provided in three or multiples of three, and each of said three are charged with a three phase voltage source.

25. The modulator of claim 12 wherein said conductors are provided in three or multiples of three, and each of said three are charged with a three phase voltage source.

26. The modulator of claim 8 wherein said conductors are provided in two or multiples of two, and said two are charged with a two phase voltage source.

27. The modulator of claim 11 wherein said fog in cross-section has the shape of a parallelogram.

28. The modulator of claim 10 wherein said fog in cross-section has the shape of a parallelogram.

29. The modulator of claim 14 wherein said fog in cross-section has the shape of an oval.

30. The modulator of claim 14 wherein said fog in cross-section has the shape of a circle.

31. The modulator of claim 15 wherein said fog in cross-section has the shape of an oval.

32. The modulator of claim 15 wherein said fog in cross-section has the shape of a circle.

33. A nozzle modulator comprising a plurality of charging electrical fields surrounding a fluid path of charged droplets from an electrostatic nozzle, and an electrical means for biasing said electrical fields and modulating said fluid paths, thereby to form a homogeneous fog from said flow path comprising uniformly disbursed droplets moving in a wide variety of directions.

34. The nozzle modulator of claim 33 wherein said fields are provided in threes and said threes are each out of phase with each other.

35. The nozzle modulator of claim 33 wherein said fields are provided in pairs, and said pairs are each out of phase with each other.

36. The nozzle modulator of claim 33 wherein said fields are attractive of said fluid path.

37. The nozzle modulator of claim 33 wherein said fields are repulsive of said fluid path.

38. The nozzle modulator of claim 33 wherein said fields are alternately attractive and repulsive of said fluid path.

39. The nozzle modulator of claim 33 wherein said fields are provided in pairs, and wherein said fields of said pairs are attractive and repulsive of said fluid path, respectively.

40. A nozzle modulator assembly comprising an electrostatic nozzle, a reservoir connected to said nozzle, a power supply connected to said nozzle, means for maintaining the fluid pressure in said reservoir and nozzle, and a modulator, said modulator having a plurality of electrical fields surrounding a fluid path of charged droplets from said nozzle, and an electrical means for biasing said electrical fields and modulating said fluid paths, thereby to form a homogeneous fog from said flow path comprising uniformly disbursed droplets moving in a wide variety of directions.

41. The modulator assembly of claim 40 wherein said fields are charged oppositely of said fluid path.

42. The modulator of claim 40 wherein said fields are charged similarly of said fluid path.

43. The modulator assembly of claim 40 wherein said fields are alternately charged and uncharged.

44. The modulator assembly of claim 40 wherein said fields are alternately charged similarly and oppositely of said fluid path.

45. A method of electrostatic spraying comprising electrostatically moving a spray of droplets from an electrostatic nozzle in a first direction, electrostatically moving said spray in a second direction, repeating said moving steps, thereby to form a homogeneous fog from said flow path comprising uniformly disbursed droplets moving in a wide variety of directions.

46. The method of claim 45 wherein said directions are opposite each other.

47. The method of claim 45 wherein said directions number greater than two, said directions are radial directions of a common diametral dimension about a common center.

48. The method of claim 47 wherein there are a plurality of said diametral dimensions.

49. A method of electrostatic spraying comprising surrounding one or more fluid paths of charged droplets from an electrostatic nozzle with a plurality of electrical fields, electrically biasing said fields, and modulating said fluid path, thereby to form a homogeneous fog from said flow path comprising uniformly disbursed droplets moving in a wide variety of directions.

50. The method of claim 49 wherein said fields are provided in threes and said threes are each out of phase with each other.

51. The method of claim 49 wherein said fields are provided in pairs, and said pairs are each out of phase with each other.

52. The method of claim 49 wherein said fields are attractive of said fluid path.

53. The method of claim 49 wherein said fields are repulsive of said fluid path.

54. The method of claim 49 wherein said fields are alternately attractive and repulsive of said fluid path.

55. The method of claim 49 wherein said fields are provided in pairs, and wherein said fields of said pairs are attractive and repulsive of said fluid path, respectively.

* * * * *

UNITED STATES PATENT AND TRADEMARK OFFICE

CERTIFICATE OF CORRECTION

PATENT NO. : 5,086,973

DATED : February 11, 1992

INVENTOR(S) : Eduardo C. Escallon, et al

It is certified that error appears in the above-indentified patent and that said Letters Patent is hereby corrected as shown below:

In Claim 33, Column 10, line 5, change to read --modulating said fluid path to form a homoge--.

In Claim 44, Column 10, line 3, change to read --said flow path--.

Signed and Sealed this

Fourteenth Day of September, 1993

Bruce Lehman

*Attest:*

BRUCE LEHMAN

*Attesting Officer*

*Commissioner of Patents and Trademarks*